US005967196A

United States Patent [19]

Moser

[11] Patent Number: 5,967,196

[45] Date of Patent: Oct. 19, 1999

[54] REFILL DEVICE FOR AN INK JET PRINT HEAD

[75] Inventor: Markus Moser, Volketswil, Switzerland

[73] Assignee: Pelikan Produktions AG, Switzerland

[21] Appl. No.: 09/053,163

[22] Filed: Apr. 1, 1998

[30] Foreign Application Priority Data

Apr. 14, 1997 [DE] Germany ..... 297 06 720 U

[51] Int. Cl.[6] ..... B41J 2/175

[52] U.S. Cl. ..... 141/18; 141/329; 141/2; 347/85

[58] Field of Search ..... 141/2, 18, 329, 141/330; 347/85, 86, 87; 53/86

[56] References Cited

U.S. PATENT DOCUMENTS 5,400,573 3/1995 Crystal et al. ..... 141/18

5,495,887 3/1996 Schwenk et al. ..... 141/370

5,531,055 7/1996 Sell et al. ..... 53/86

5,838,352 11/1998 Martinez ..... 347/85

*Primary Examiner*—Steven O. Douglas

*Attorney, Agent, or Firm*—Fay, Sharpe, Beall, Fagan, Minnich & McKee, LLP

[57] ABSTRACT

The device comprises a holder (10), which has a bottom (11) with a sealing element (17) for sealing off the air supply opening to a bubble generator of print head (2) and, at the top, an arm (15) with a passage bore (16). A spike (23) serves for boring or piercing an opening (28) to the ink reservoir in a cover area (5) of the print head (2). An ink reservoir (27) is inserted with a hollow needle into the created opening (28). The reservoir (27) has in a bore (32) of lid (31) a cone (33). A closing element (22) serves for closing an air supply opening (6) of a lung of the print head (2).

15 Claims, 1 Drawing Sheet

32
33
31
26
27
25
23
24
22
16
15
5
6
14
29
19
28
13
30
12
2
10
4
3
18
11
17

REFILL DEVICE FOR AN INK JET PRINT HEAD

BACKGROUND OF THE INVENTION

The present invention relates to the art of filling ink jet cartridges and will be described with particular reference thereto.

A refill device for an ink jet print head is known from U.S. Pat. No. 5,495,877. The device has a holder for insertion of the print head with snap-elements to hold the jet plate and an air supply opening to a bubble generator of the print head against respective sealing platelets for tight-fitting contact. After installation of the print head, a sealing support is put in place, which seals an air supply opening in the lid. A hollow needle support is placed on the holder, which impresses, with a hollow needle, a ball in a charging opening of the print head in the ink reservoir space. The other end of the hollow needle is pointed. On it is placed an ink reservoir which is sealed with an elastomer stopper. Its lid is removed so that the ink flows into the storage space. After removal of the hollow needle support, the charging opening is closed and the print head removed from the holder. This prior device requires a charging opening in the lid of the print head which is closed by means of a pressed-in ball. However, not all print heads of this type have a pre-formed charging opening.

The present invention contemplates a new and improved apparatus and method for refilling an ink jet cartridge which overcomes the above-referenced problems and others.

SUMMARY OF THE INVENTION

A new and improved ink refill method and apparatus for an ink jet print head is provided. A refill device is suitable for refilling ink in an ink jet pen which includes a housing having an ink jet print head, an ink chamber, a bubble generator and an air vent. The refill device includes a holder which receives the ink jet pen. The holder has a movable arm for engaging the housing of the ink jet pen and locking the ink jet pen within the holder. A bore is formed through the movable arm. An air vent sealing member is provided to seal the air vent of the housing. A spike forms a refill hole through the housing to the ink chamber of the pen which is insertable through the bore of the movable arm. An ink reservoir refills the ink chamber of the ink jet pen with ink and includes a hollow needle adapted for insertion into the refill hole through the bore, and a vent hole which communicates ambient air into the ink reservoir. The vent hole is sealed by a plug which is adapted to be removed from the vent hole and sealingly inserted into the refill hole formed in the housing of the ink jet pen.

The present invention is based on the object of providing a refill device which is also suitable for print heads lacking a charging opening in the lid. This object is solved by the combination of the characteristics of the present invention.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
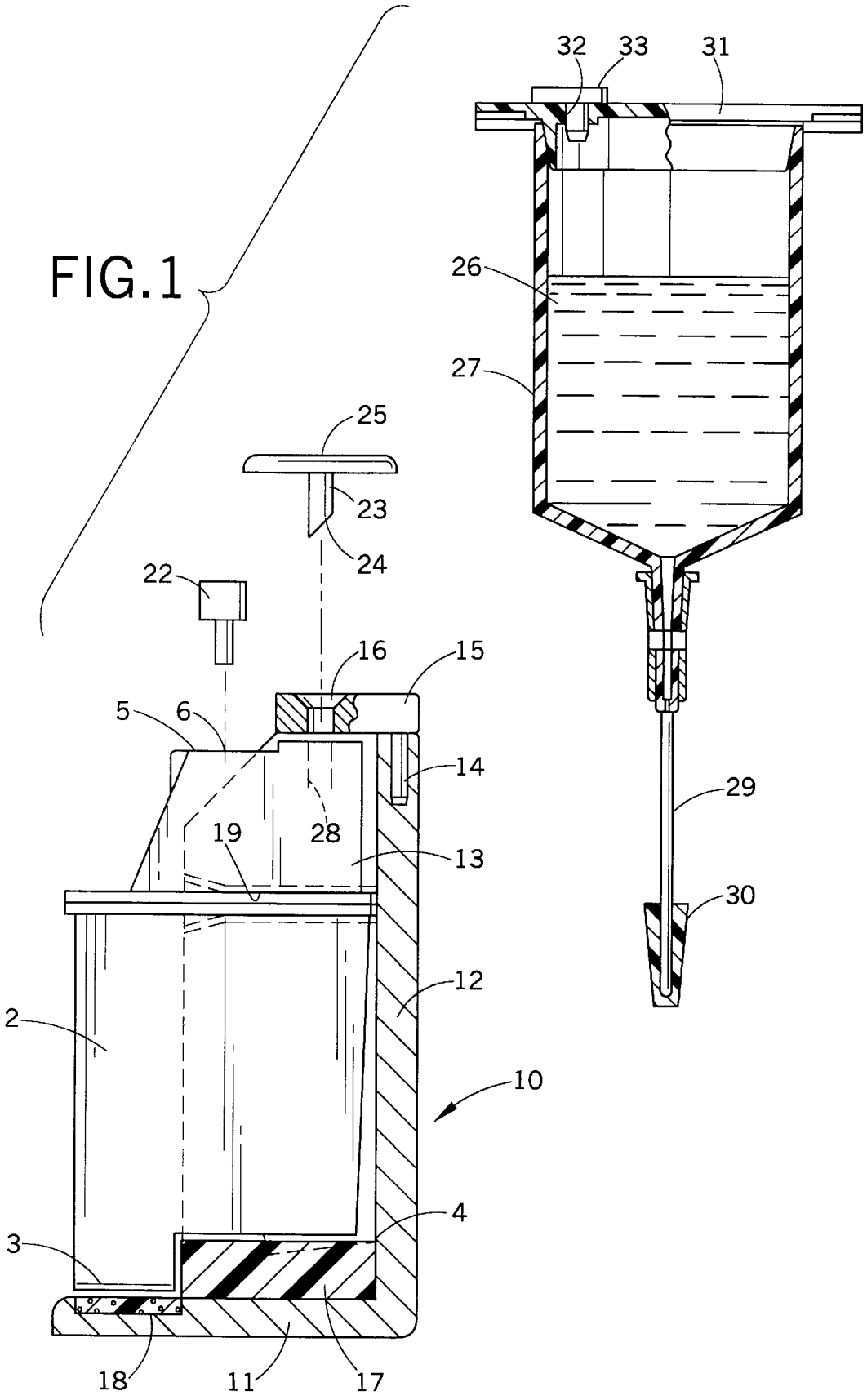
FIG. 1 illustrates a refill device, partially in section in accordance with the present invention.

With reference to FIG. 1, a refill device 1 is intended for a print head 2, which has a jet plate 3 at the bottom and also an air supply opening 4 to a bubble generator. In lid 5, there is a ventilation opening 6 in fluid communication with a "lung" or pressure accumulator located in the ink reservoir space.

The refill device 1 comprises a holder 10 having a bottom wall 11, a back wall 12 and two side walls 13 for receiving and accurate positioning of the print head 2. At the rear wall 12 there is attached at the top an arm 15 which swivels around a vertical axis 14, and includes a passage bore 16 therethrough. In the represented installed position, arm 15 lies against a stop and presses on the lid 5 of the print head. During installation of print head 2, the opening 4 is pressed, by means of two track-like grooves 19 in the two side walls 13, against an elastomer sealing plate 17 on the bottom wall 11. The jet plate 3 is pressed on a porous, for example moistened absorbent element 18, for example made of foam material. Thus, the jet plate 3 is cleaned at the same time.

The device 1 also includes a cone 22 for closing the air opening 6. A metal spike 23 includes a bottom surface 24 which is ground sharp-angled, obliquely in relation to the axis of the spike 23 and which has a round disc 25 at its top. A reservoir 27 contains a supply of ink 26.

To provide access to the ink reservoir of the print head 2, a round hole 28 is pierced or bored through lid 5 through opening 16 using the spike 23. The opening 16 in arm 15 guides the spike 23 to easily pierce the housing. It has been shown that the ink feed location at lid 5 can readily be pierced. By exact positioning of print head 2 in holder 10 and by securing it with arm 15, a weak spot in the lid is reproducibly reached. The reservoir 27 has at the bottom a hollow needle 29, whose tip is capped with an elastomer stopper 30. Lid 31 has a passage bore or air hole 32 in which is inserted another elastomer cone or sealing plug 33. The diameter of the cone 33 corresponds to the diameter of spike 23.

To refill the ink chamber of the print head, the cone 22 is sealingly inserted into air opening 6 and a refill hole 28 is formed by piercing the housing with the spike 23 through opening 16. The stopper 30 and needle 29 are placed on opening 16. The needle 29 is pushed through the stopper 30 and through the openings 16, 28 into the ink reservoir space of print head 2. The cone 33 is then removed, opening the air hole 32 so that the ink 26 flows into the print head 2. After reservoir 27 has been emptied, it is pulled off, arm 15 swivelled out of the way and the cone 33, which was removed from lid 31, is inserted in opening 28, so that same is hermetically sealed. The cone 22 is now pulled out and the filled print head 2 removed from holder 10.

It is also conceivable to design the hollow needle 29 to function as spike 23. In that case, stopper 30 and bore 16 should be dimensioned in such manner that with piercing of needle 29, the front of stopper 30 seals against lid 5. In order to facilitate evacuation of air from the interior of the print head 2 during the filling of ink 26, there may be provided at needle 29, remote from its top, at least one longitudinal groove.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A refill device for an ink jet print head having a housing including a jet plate, an air supply opening, an ink chamber and a bubble generator air supply opening, the refill device comprising:

a holder, which has a bottom with a sealing element for sealing of the bubble generator air supply opening of the print head and, at the top, an arm for securing the print head within the holder and including a passage bore;

a spike for boring or piercing an opening through the housing to the ink chamber of the print head; and, an ink reservoir having a hollow needle extending out therefrom for insertion into the opening, the ink reservoir including a lid having a bore which is sealed by a removable plug, and also a closing element for closing of the air supply opening of a lung of the print head.

2. The refill device according to claim 1 wherein the removable plug has a cylindrical part with a diameter which approximately corresponds to a diameter of the spike so that the removable plug, after withdrawal of the hollow needle is installable in the opening for sealing same.

3. The refill device according to claim 1 further including an absorbent element attached to the holder for cleaning the jet plate of print head the absorbent element contacting the jet plate when the print head is installed on the holder.

4. The refill device according to claim 1 wherein the arm is swivelly attached to the holder.

5. The refill device according to claim 1 wherein the closing element is a cone.

6. The refill device according to claim 1 wherein a disc is attached to the spike.

7. The refill device according to claim 1 wherein the hollow needle includes a tip which is closed-off by an elastomer stopper which is pierced during insertion of the hollow needle in the bore.

8. The refill device according to claim 1 wherein the hollow needle is shaped as a spike for boring or piercing of the opening.

9. A refill device for refilling ink in an ink jet pen which includes a housing having an ink jet print head, an ink chamber, a bubble generator and an air vent, the refill device comprising:

a holder for receiving the ink jet pen, the holder including a movable arm for engaging the housing of the ink jet pen and locking the ink jet pen within the holder, the movable arm including a bore formed therethrough;

an air vent sealing member for sealing the air vent of the housing;

a spike for forming a refill hole through the housing to the ink chamber of the pen, the spike being insertable through the bore of the movable arm; and an ink reservoir for filling the ink chamber of the ink jet pen with ink, the ink reservoir including:

a hollow needle adapted for insertion into the refill hole through the bore; and a vent hole for communicating ambient air into the ink reservoir, the vent hole being sealed by a plug, the plug being adapted to be removed from the vent hole and sealingly inserted into the refill hole formed in the housing of the ink jet pen.

10. The refill device as set forth in claim 9 further including a sealing plate attached to the holder being adapted to seal the bubble generator of the ink jet pen when received within the holder.

11. The refill device as set forth in claim 9 wherein the hollow needle includes a tip being sealed by a cap, the cap being pierceable by the needle as the needle is inserted into the refill hole.

12. A method of refilling an ink pen including a housing having an ink jet print head, an ink chamber which supplies ink to the print head, and an air vent, the method comprising the steps of:

mounting the ink pen within a holder;

sealing the air vent;

forming a refill hole through the housing to the ink chamber;

connecting an ink reservoir, having an air hole sealed with a plug, to the refill hole by inserting a needle sealed on a tip with a cone into the refill hole, the needle being in fluid communication with the ink reservoir and the cone being mounted in the refill hole and pierced by the needle;

transferring ink from the ink reservoir to the ink chamber by removing the plug from the air hole of the ink reservoir; and, sealing the refill hole with the plug.

13. The method of refilling as set forth in claim 12 further including sealing a bubble generator formed on the housing of the ink pen.

14. The method of refilling as set forth in claim 12 further including securing the ink pen within the holder with a moveable arm attached to the holder, the moveable arm including a bore such that the refill hole is formed through the bore.

15. The method of refilling as set forth in claim 12 wherein the forming includes piercing the housing.

* * * * *